US006364706B1

(12) United States Patent
Ando et al.

(10) Patent No.: US 6,364,706 B1
(45) Date of Patent: Apr. 2, 2002

(54) SHIELDED ELECTRICAL CONNECTOR WITH FLANGE SUPPORT MEMBER

(75) Inventors: Shigeru Ando, Yamato; Shinichiro Maruyama, Ayase, both of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/420,125

(22) Filed: Oct. 19, 1999

(30) Foreign Application Priority Data

Oct. 19, 1998 (TW) ..... 087217215

(51) Int. Cl.[7] ..... H01R 13/648
(52) U.S. Cl. ..... 439/607; 439/939
(58) Field of Search ..... 439/607, 564, 439/939, 569, 609

(56) References Cited

U.S. PATENT DOCUMENTS

| | | | | |
|---|---|---|---|---|
| 4,571,012 A | | 2/1986 | Bassler et al. | |
| 4,895,535 A | | 1/1990 | Emadi et al. | 439/681 |
| 4,938,704 A | | 7/1990 | Fujiura | 439/95 |
| 5,013,262 A | | 5/1991 | Shibano | 439/610 |
| 5,037,331 A | * | 8/1991 | Goodman et al. | 439/607 |
| 5,094,627 A | | 3/1992 | Uekido | 439/610 |
| 5,169,339 A | | 12/1992 | Nakata et al. | 439/607 |
| 5,227,957 A | | 7/1993 | Deters | 361/395 |
| 5,310,364 A | | 5/1994 | Hooper et al. | 439/724 |
| 5,438,160 A | | 8/1995 | Batty | 174/52.1 |
| 5,622,522 A | * | 4/1997 | Tan et al. | 439/607 |
| 5,637,014 A | | 6/1997 | Sukegawa et al. | 439/607 |
| 5,685,739 A | | 11/1997 | Davis et al. | 439/607 |
| 5,785,557 A | | 7/1998 | Davis | 439/660 |
| 5,865,646 A | | 2/1999 | Ortega et al. | 439/607 |
| 5,984,725 A | * | 11/1999 | Belopolsky et al. | 439/607 |
| 6,019,632 A | * | 2/2000 | Ozai et al. | 439/564 |
| 6,056,600 A | * | 5/2000 | Watanabe et al. | 439/607 |

FOREIGN PATENT DOCUMENTS

| | | | |
|---|---|---|---|
| EP | 0 304 028 | 8/1988 | H01R/13/70 |
| JP | 8-7989 | 1/1996 | H01R/13/71 |
| JP | 8-203614 | 8/1996 | H01R/13/648 |
| JP | 8-203615 | 8/1996 | H01R/13/648 |
| JP | 8-203616 | 8/1996 | H01R/13/648 |

* cited by examiner

*Primary Examiner*—Tulsidas Patel
*Assistant Examiner*—Hae Moon Hyeon
(74) *Attorney, Agent, or Firm*—Robert J. Zeitler

(57) ABSTRACT

A shielded electrical connector is provided having enhanced structural rigidity. The connector includes a metallic shield formed of a shaped metal blank, wherein two longitudinal edges of the sheet meet at a seam. The shield also includes one or more flanges at a front of the connector adapted to be secured against a computer panel or chassis. The connector an insulative housing which includes a support beam that extends from the rear side of the housing forwardly along a wall of the shield. A front surface of the support beam is disposed behind the flange to prevent rearward deformation of the flange. In an embodiment, the support beam extends along the seam to prevent the shield from deflecting and spreading apart at the seam.

18 Claims, 12 Drawing Sheets

SHIELDED ELECTRICAL CONNECTOR WITH FLANGE SUPPORT MEMBER

BACKGROUND OF THE INVENTION

The present invention relates to electrical connectors, and more particularly to a shielded connector having enhanced structural integrity.

USB (Universal Serial Bus) mated plug-type connectors are widely used in computers for integrating the input/output transmission of a computer peripheral, such as a keyboard, a mouse and/or a modem. Integrating several different peripheral dedicated connectors into one USB connector reduces the number of slots and wires at the back of the computer. Conventionally, USB connectors have a metallic shield to provide electromagnetic shielding and also to mount the connector on a circuit board. However, conventional USB connectors have suffered from loosening problems over a period of use, being subjected to repeated inserting, extracting and shaking of the mated plug. In particular, a seam of the metallic shield has been known to crack or separate, permitting the shield to undesirably spread apart. It is desirable to enhance the structural stability of USB connectors to ensure the signal transmission quality.

SUMMARY OF THE INVENTION

The present invention provides a shielded electrical connector having a support member for improving the rigidity of the shield and improving overall connector integrity. In an embodiment, the connector includes a housing with a terminal support with a plurality of terminal cavities. A plurality of conductive terminals reside in the terminal cavities. Each of the terminals has a contact portion for mating with a respective terminal of a mating connector and a tail portion for engaging a respective conductor on a circuit board on which the connector is to be mounted. The connector further includes a conductive shield around the terminal support. The shield has walls around the terminal support, the walls including opposed side walls, a top wall and a bottom wall, and a plurality of flanges flaring outwardly from the walls around a front opening for receiving the mated plug. The flanges firmly seat against a computer panel or chassis and enhance the mounting rigidity of the connector. Moreover, at least one of the flanges has an aperture for affixing said connector to a panel, such as with a screw. The insulative housing has at least one support beam extending along an outside surface, the support beam of the housing having a front surface disposed behind a rear surface of the apertured flange at the front of the shield.

According to an embodiment of the present invention, the support beam extends from the bottom side of the insulating housing. Additionally, in an embodiment, the support beam is placed below the seam between the two bottom panels of the shield, providing support along the seam to reduce flexing of the shield at that location. Therefore, the bottom panels of the metallic shield will not bend and spread apart despite repeated inserting, extracting and shaking of the plug.

According to an embodiment, the connector has two support beams that extend from opposite lateral sides of the insulating housing. The support beams receive the shield, each of the slots clamping one of the side walls of the shield. This prevents the two lateral sides of the shield from bending.

According to an aspect of the present invention, the shield has at least one retaining flange with a threaded hole extended from at least one lateral side of the metallic shield.

The flange enables the connector to be mounted to a computer chassis or panel with additional securing force by tightening a screw into the threaded hole. Moreover, the retaining flange provides a grounding point and can thereby eliminate a static charge on the metallic shield. Each of the aforementioned support beams includes a frontwardly-facing support surface disposed behind a rear side of one or more of the flanges surrounding the front opening of the shield.

Additional features and advantages of the present invention are described in, and will be apparent from, the following detailed description when read in conjunction with the appended drawings.

DETAILED DESCRIPTION OF THE PRESENTLY PREFERRED EMBODIMENTS

Figure 1:
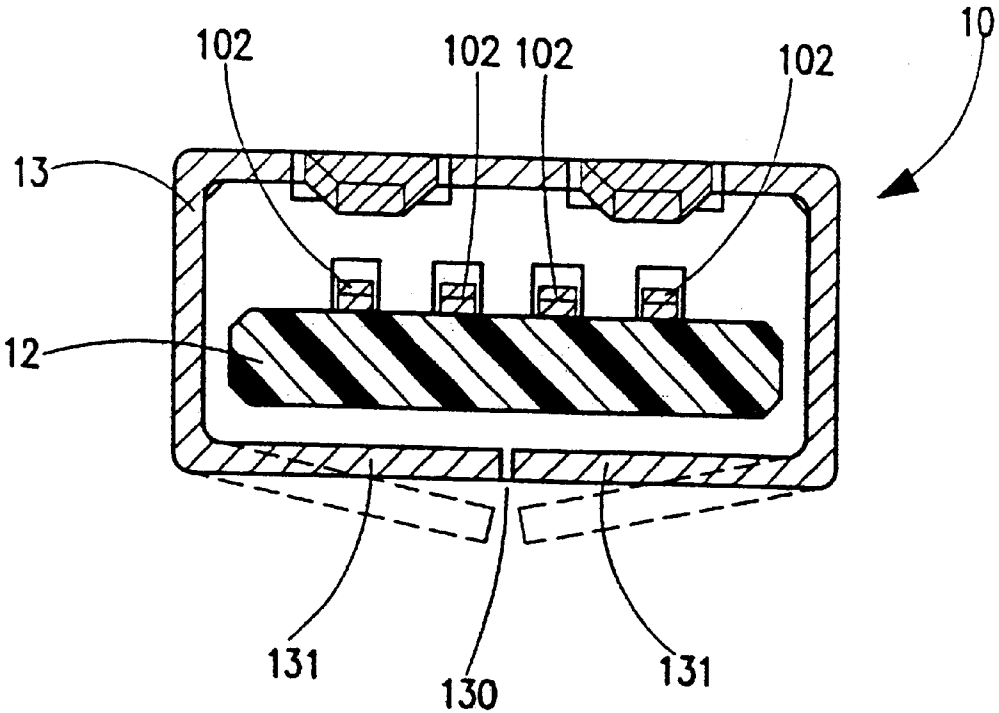
FIG. 1 (PRIOR ART)
FIG. 1 is a cross sectional view of a conventional connector.

Now referring to the drawings, wherein like numerals designate like components, FIG. 1 illustrates a conventional connector 10. Connector 10 includes an insulative housing 12 which holds a plurality of conductive terminals 102 and a metallic shield 13 at least partially enclosing the insulative housing 12. Connector 10 has an opening configured to receive a mated plug (not shown) for establishing conductive contact with the terminals in a generally known manner.

The metallic shield 13 is formed by bending a metal blank around a frame into a rectangularly cross-sectioned tube so that two opposite ends of the sheet meet at a seam 130. The seam 130 is a structurally weak part of the connector 10. When the mating plug is inserted in a misaligned manner, the conventional connector 10 can break along the seam 130 such that the two bottom panels 131 adjacent to the seam 130 are split apart. The connector 10 then has an excessively large opening so that the mating plug does not engage tightly and may become disconnected.

Figure 2:
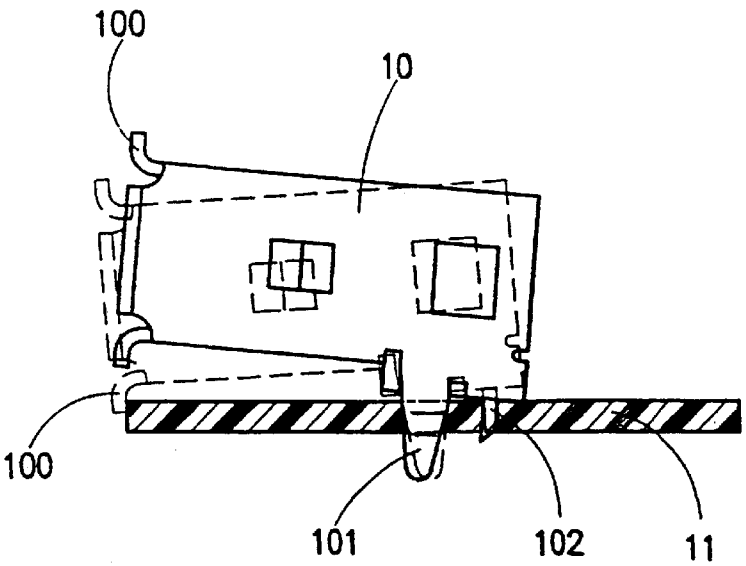
FIG. 2 (PRIOR ART)
FIG. 2 is a side view of the conventional connector of FIG. 1 as mounted to a circuit board, illustrating undesirable shifting when subjected to force in up and down directions.
Figure 3:
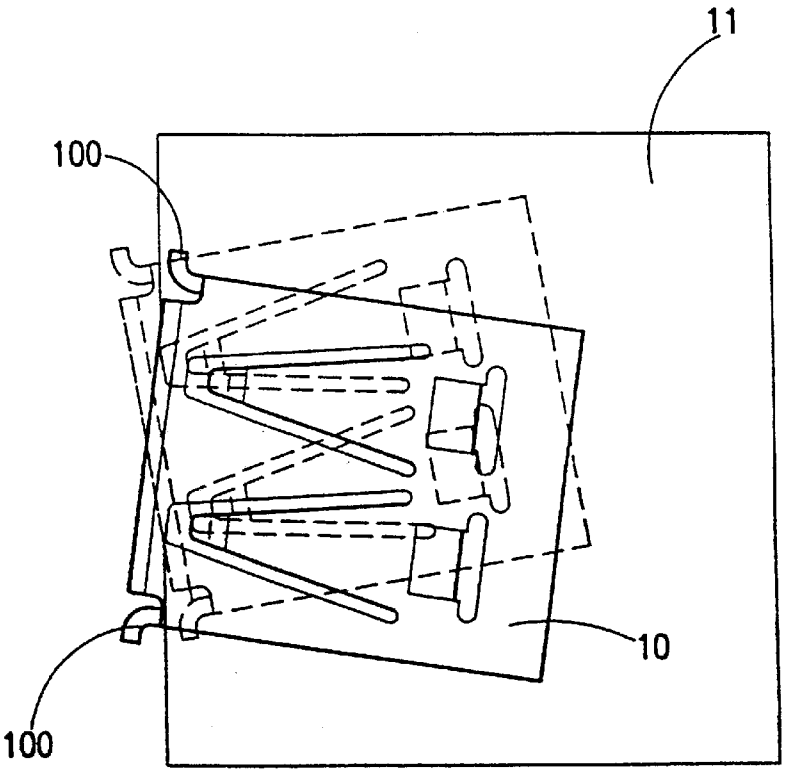
FIG. 3 (PRIOR ART)
FIG. 3 is a plan view of the conventional connector of FIG. 1 mounted to a circuit board, illustrating undesirable deflection when subjected to force in right and left directions.
Figure 4:
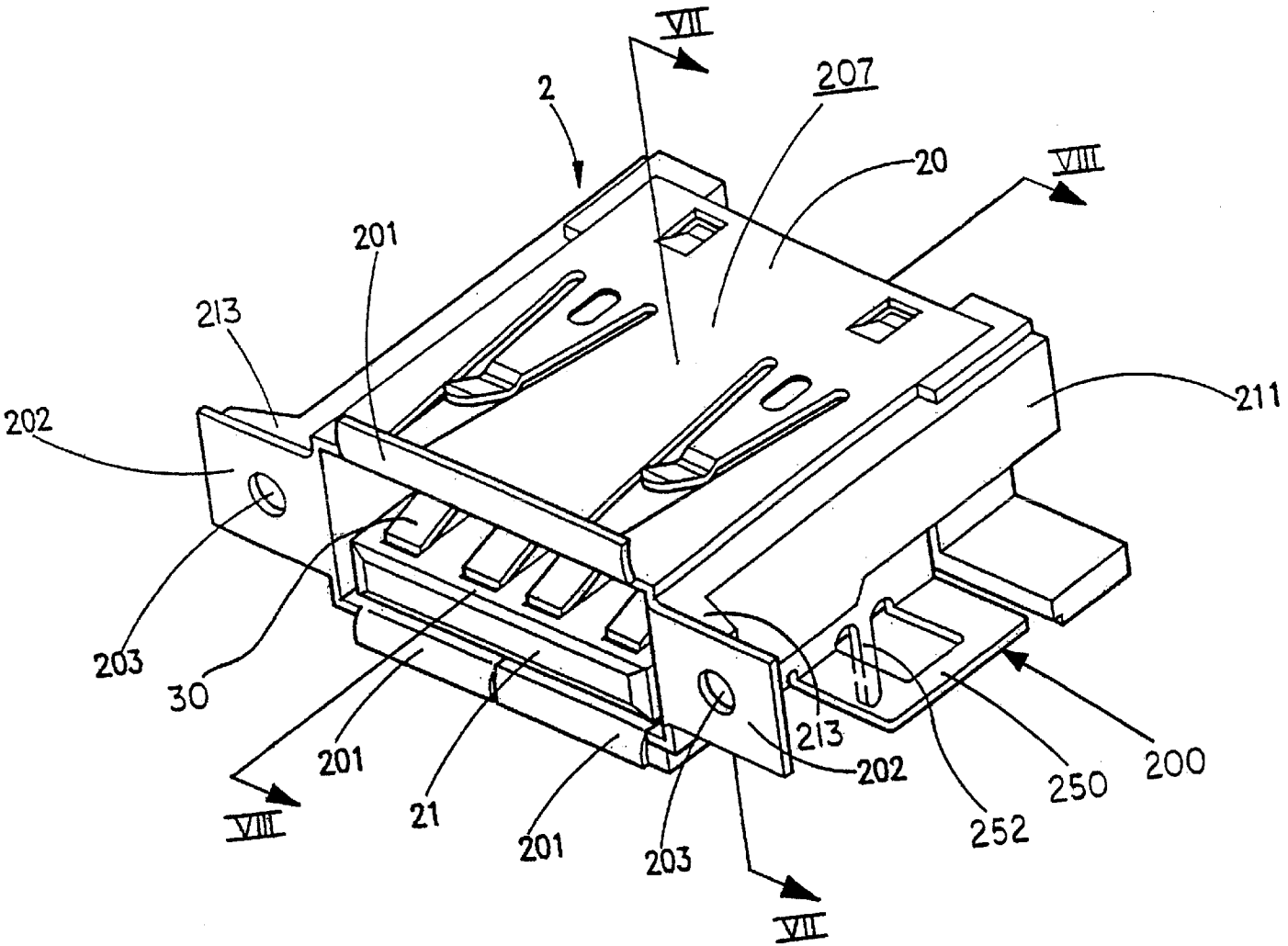
FIG. 4 is a perspective view of a retaining device for an electrical connector according to a first embodiment of the present invention.

FIGS. 2 and 3 illustrate the conventional connector 10 as mounted to a circuit board 11, and further show problematic shifting and loosening of the conventional connector relative to the circuit board. The shield has flared contact flanges 100 at the opening of the connector 10 may be subjected to an excessive external force. The undue external force typically occurs when the mating connector is carelessly inserted with improper alignment. FIG. 2 shows deflection of the connector 10 relative to the circuit board when subjected to force having an up or down component, and FIG. 3 shows deflection of the connector 10 when subjected to force having a right or left component. As a result, retaining legs 101 extending downwardly from the shield 13 and terminals soldered on the circuit board 11 may be loosened or detached. This can cause the signal transmission quality to deteriorate or terminate.

Now turning to FIGS. 4–8, an electrical connector 2 is illustrated according to a first embodiment of the present invention, and FIGS. 9–13 illustrate an electrical connector 2' according to a second embodiment. According to an aspect of the invention, each of the connectors 2, 2' includes a retaining device or support beam, 210' to provide enhanced integrity to the metal shield 20, 20'. In particular, the support beams, 210', provide support behind apertured mounting flanges 202, 202'.

Referring to the embodiments of FIGS. 4–8 and FIGS. 9–13, respectively, the connector 2, 2' includes an insulating housing 21, 21' with a terminal support that holds a plurality of conductive terminals 30, 30' and a metallic shield 20, 20' which at least partially encloses the insulating housing 21, 21'. The metallic shield 20, 20' has a plurality of retaining legs 200, 200' extended from two bottom lateral sides thereof and soldered to the circuit board 3, 3'. In the illustrated embodiments, the support beam 210, 210' is a portion of the housing 21, 21' that extends forwardly along an underside of the respective connector 2, 2' against the shield 20, 20'. The connector 2 of FIGS. 4–8 is configured for surface mounting to the circuit board 3, wherein the tail ends of the terminals 30 are bent rearwardly for contacting associated surface contact pads on the circuit board. The connector 2' of FIGS. 9–13 has terminals 30' adapted for inserting into though-hole contacts in the circuit board 3'.

Figure 6:
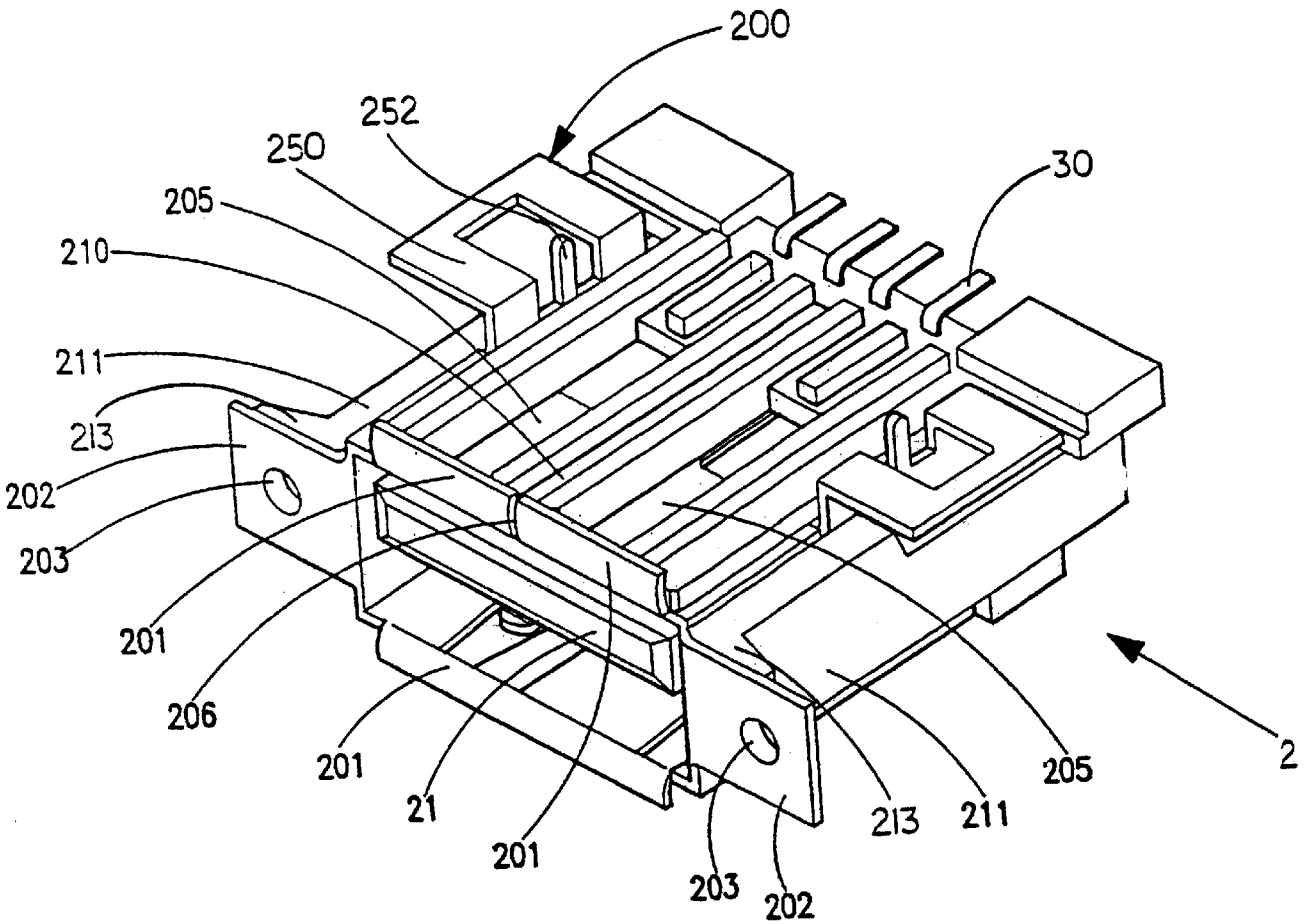
FIG. 6 is a perspective view of the connector of FIG. 4 shown from an underside perspective.
Figure 7:
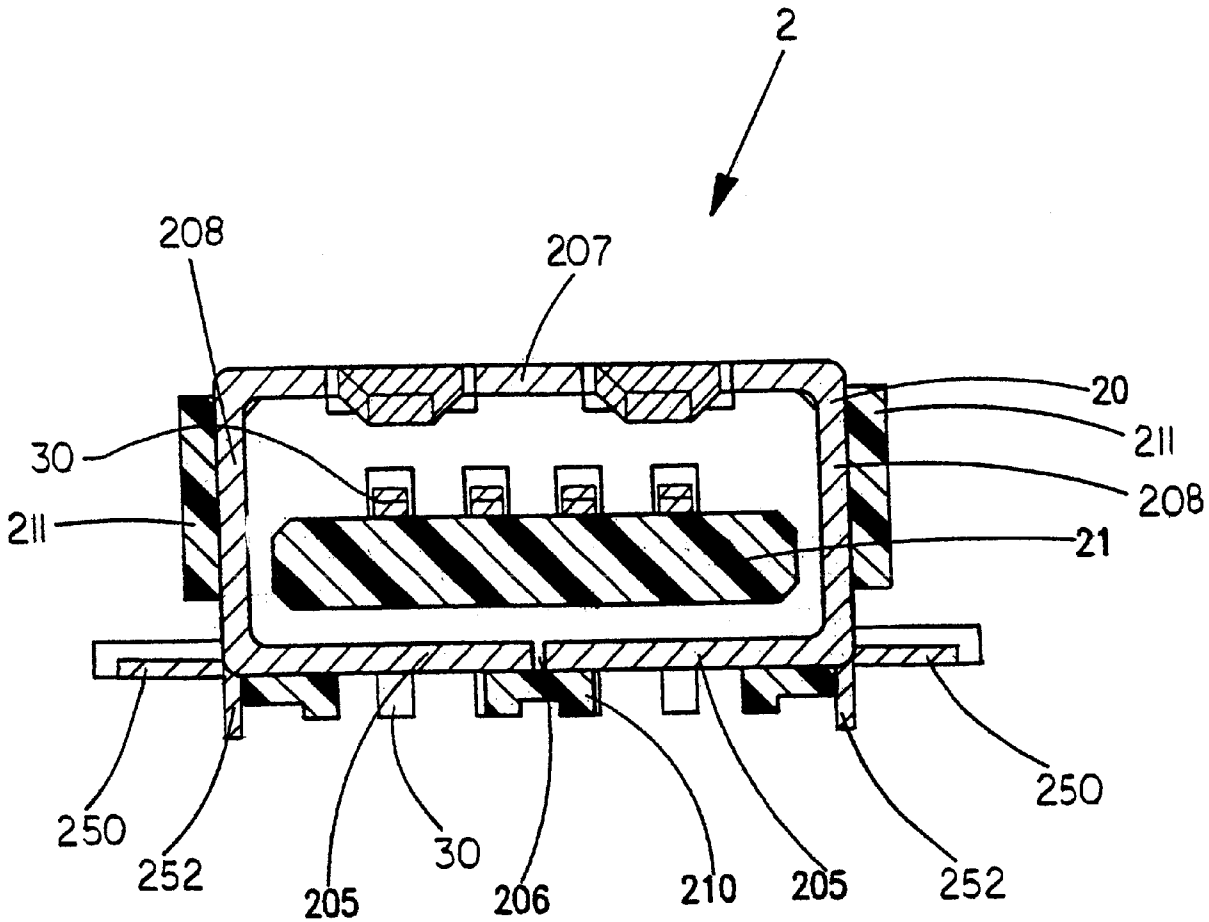
FIG. 7 is a lateral cross sectional view of the electrical connector as taken generally along line VII—VII of FIG. 4.
Figure 8:
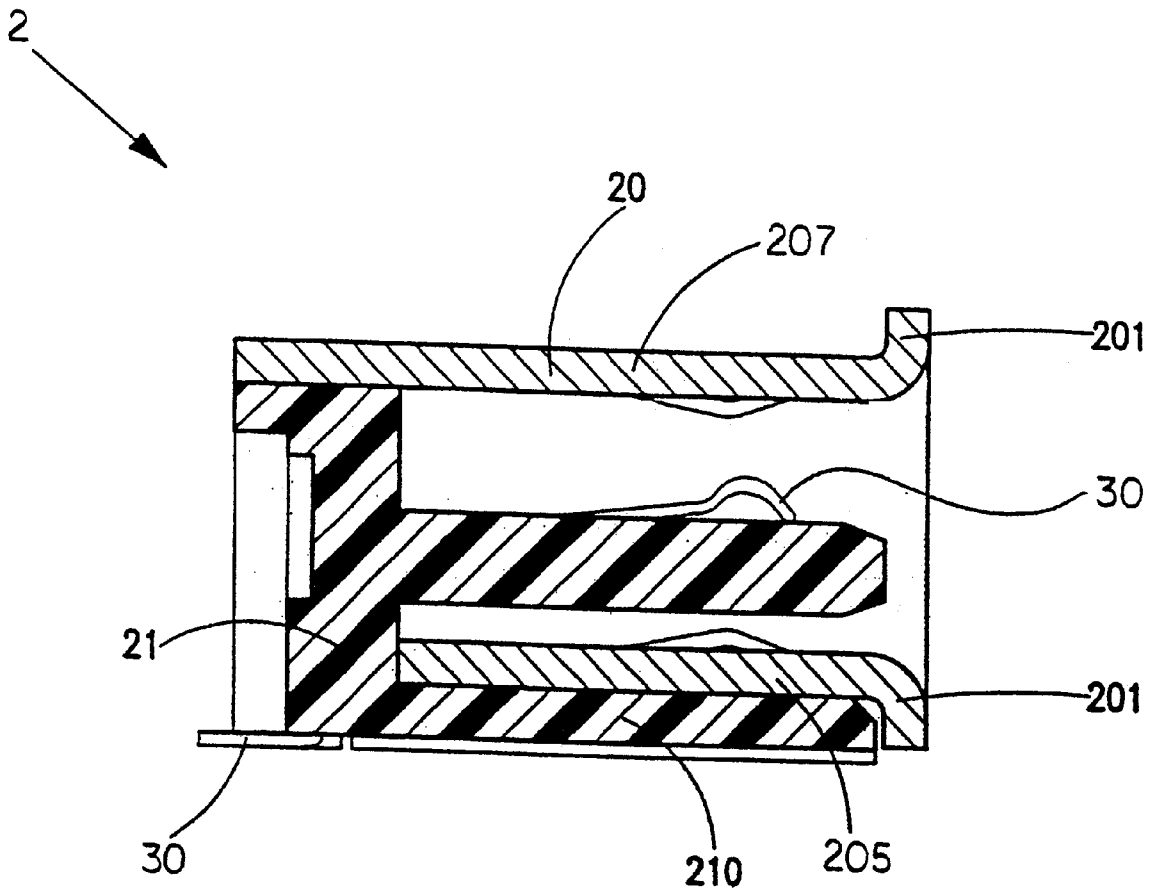
FIG. 8 is a longitudinal cross section view of the connector as taken generally along line VIII—VIII of FIG. 4.
Figure 11:
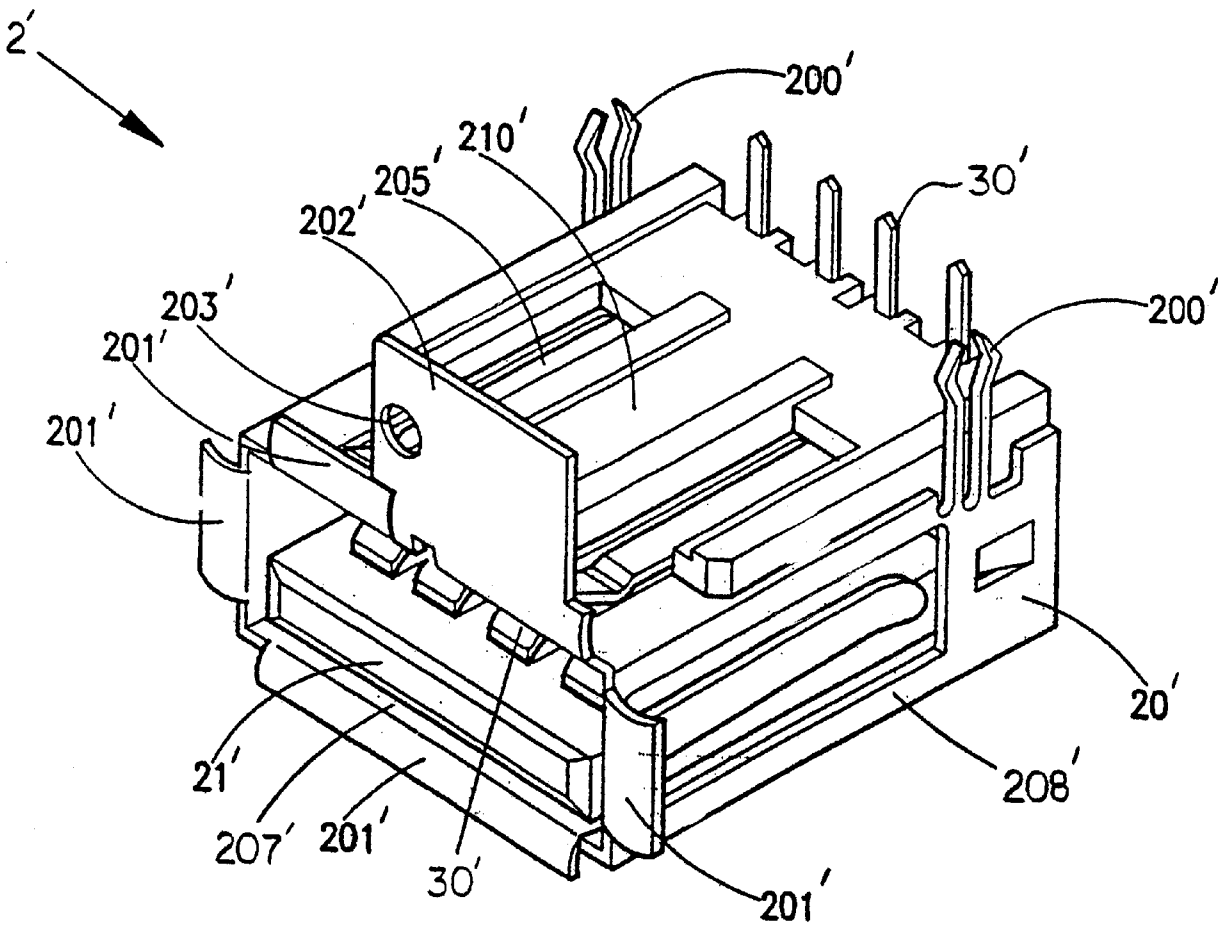
FIG. 11 is a perspective view of the connector of FIG. 9 shown from an underside perspective.
Figure 12:
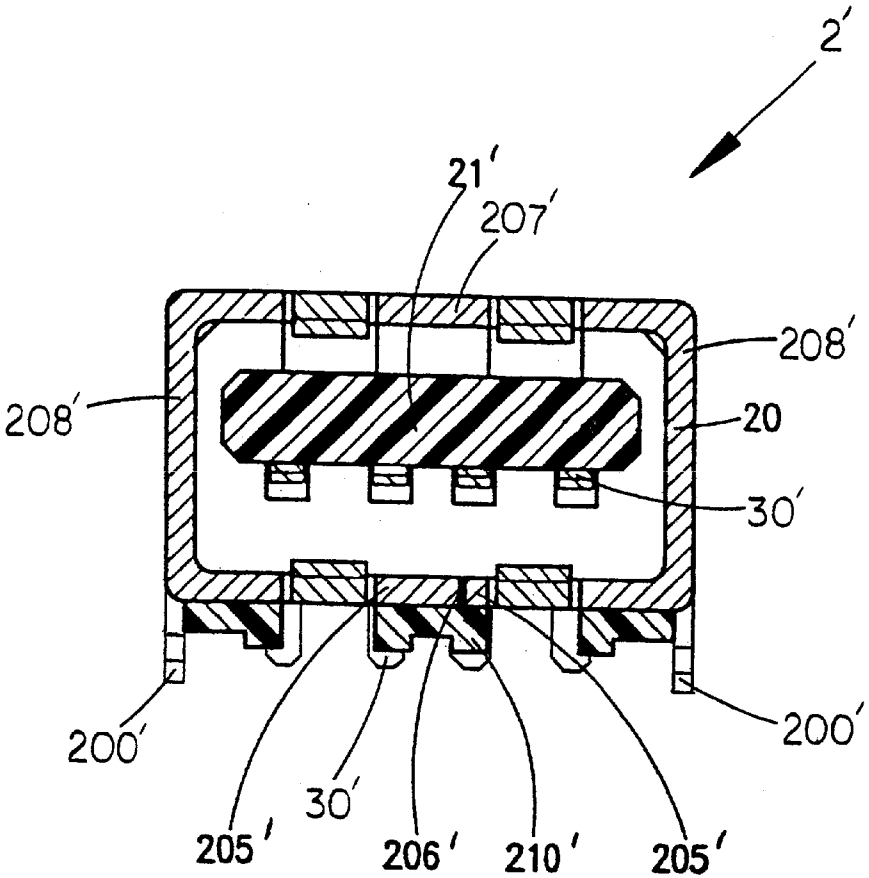
FIG. 12 is a lateral cross sectional view of the connector as taken generally along line XII—XII of FIG. 9.

As shown respectively in FIGS. 6 and 11, support beam 210, 210' extends from the rear side of the insulating housing 21, 21' along an underside of the connector. As shown in FIGS. 7 and 12, the support beam 210, 210' is positioned below a seam 206, 206' of the shield 20, 20' formed by joined edges of two bottom walls 205, 205' of the metallic shield 20, 20'. The support beam 210, 210', together with the insulating housing 21, 21', clamps the two bottom walls 205, 205' and prevents the bottom walls 205, 205' from bending open or spreading apart at the seam 206, 206'.

Figure 5:
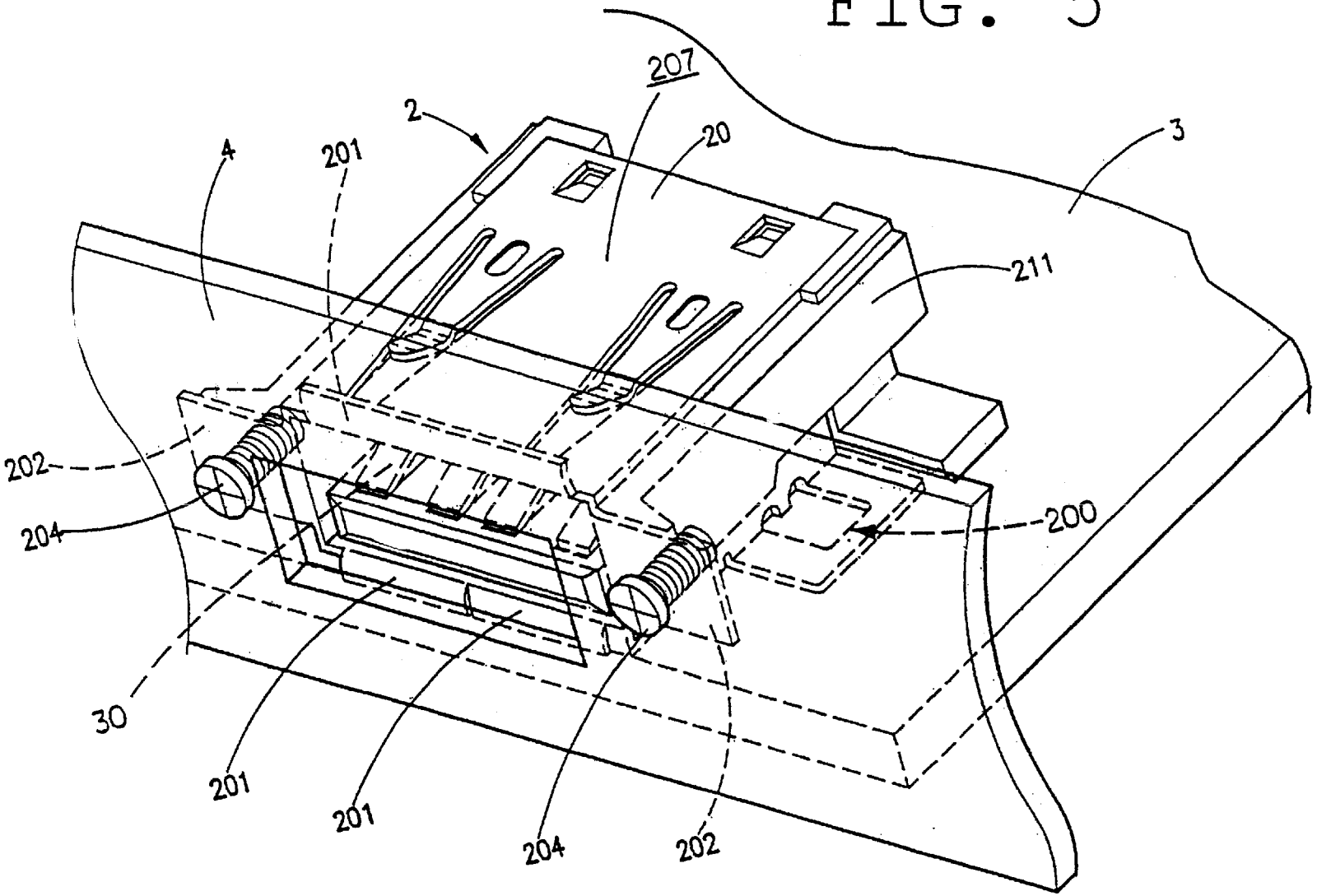
FIG. 5 is a perspective view of the connector of FIG. 4 as installed.
Figure 9:
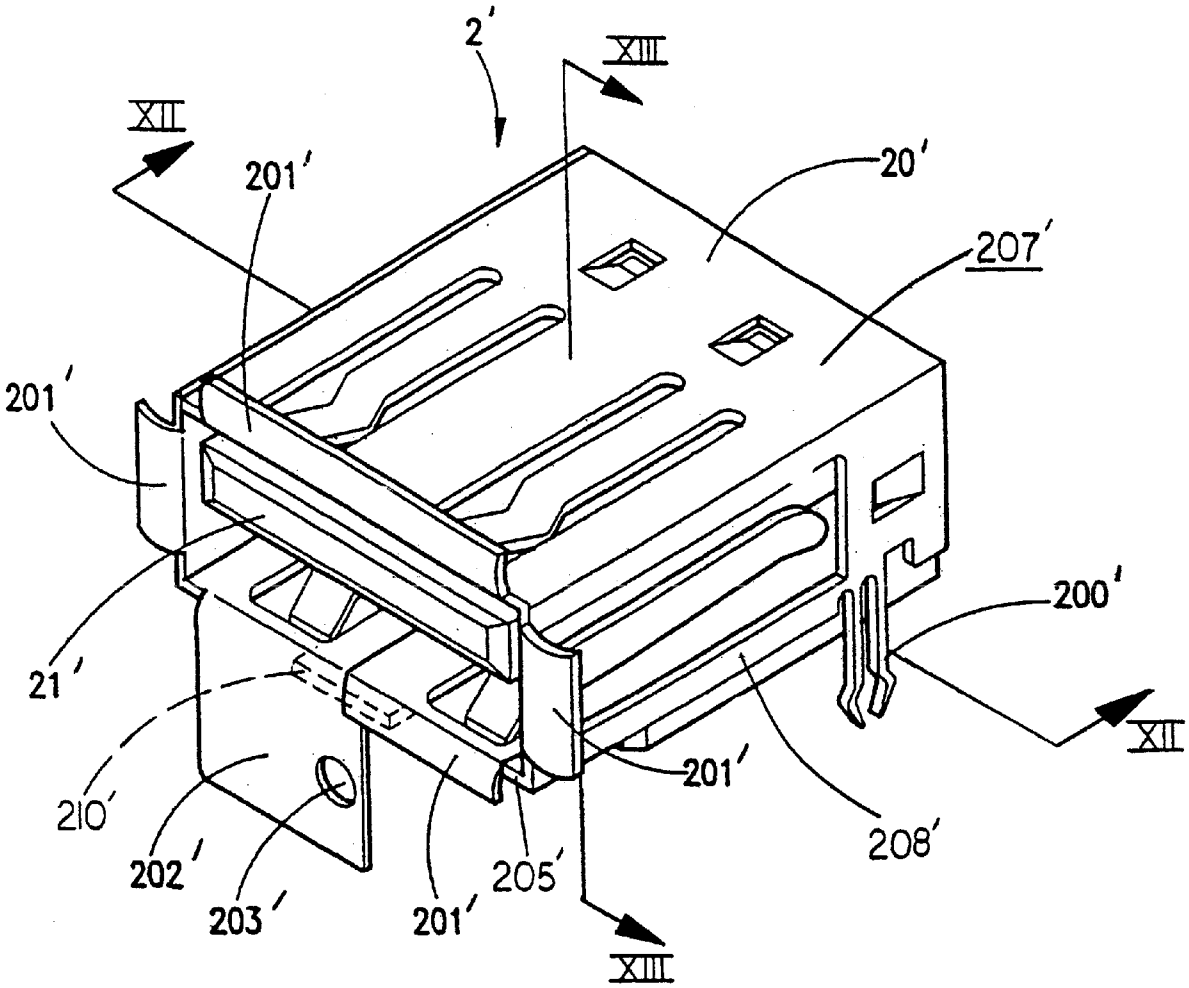
FIG. 9 is a perspective view of an electrical connector according to a second embodiment of the present invention.
Figure 10:
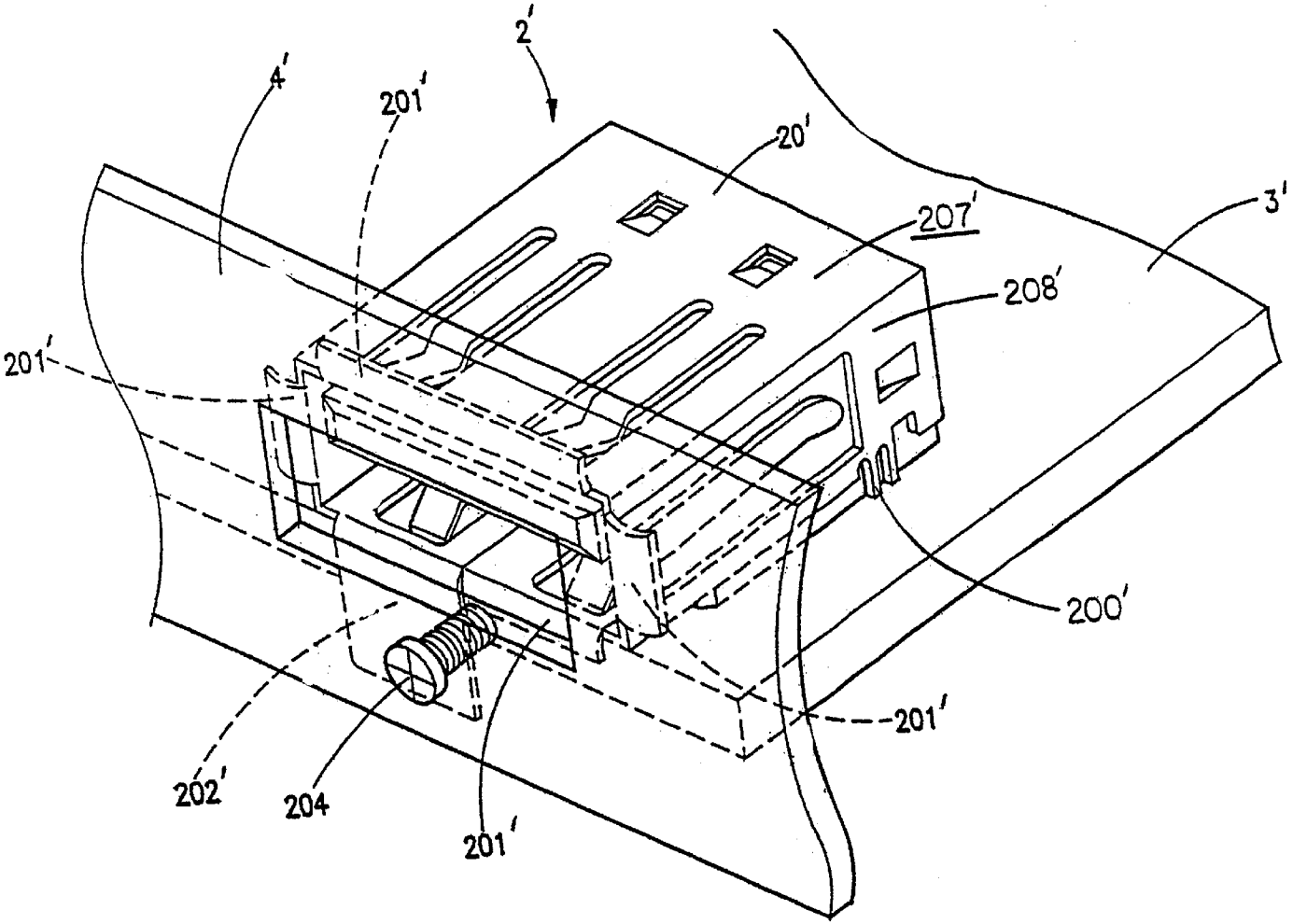
FIG. 10 is a perspective view of connector of FIG. 9 as installed.

As shown in FIGS. 5 and 10, the connectors 2, 2' are mountable to a circuit board 3, 3', respectively so that the conductive terminals 30, 30' contact conductive pads (not shown) on the circuit board 3, 3'. To secure the connectors 2, 2' to the circuit board, the shield 20, 20' includes a plurality of retaining legs 200, 200' configured to extend through an aperture on the circuit board 3, 3'. Specifically, the connector 2 of FIGS. 4–8 includes a pair of retaining legs 200 descending from sides of the shield 20. Each of the legs 200 has a foot portion 250 configured to rest against the circuit board 3 and a mounting prong 252 for extending through an aperture on the circuit board 3. The connector 2' of FIGS. 9–13 includes board lock retaining legs 200' which resiliently engage in the aperture of the circuit board 3'.

The shield 20, 20' of the illustrated connectors 2, 2' has the bottom walls 205, 205' a top wall 207, 207' and two opposing side walls 208, 208'. The walls define a front opening configured to receive a mated plug (not shown). For providing enhanced mounting stability, the shield 20, 20' includes a plurality of contact flanges 201, 201', and at least one retaining flange 202, 202' flaring outwardly along the edges of the front opening. The support beam 210, 210' has a front segment forming a front surface disposed behind a rear surface of the lower flange 201, 201', 202' that extends from the respective bottom walls 205, 205'. The front surface of the support beam 210, 210' prevents the lower flange 201, 201', 202' from bending rearwardly to a point of deformation. The support beam 210, 210' thus additionally enhances the structural strength of the connector 2, 2'. Additional grounding of the shield 20, 20' is provided by the contact of the flanges 201, 202, 201' and 202' against the panel, which is typically metal.

More particularly, connector 2 illustrated in FIGS. 4–8 has two retaining flanges 202 which extend from opposite lateral sides 208 of the metallic shield 20 adjacently to the front opening. Additionally, the shield 20 includes a plurality of the contact flanges 201 flaring outwardly from upper and lower edges of the plug opening. The retaining flanges 202 and contact flanges 201 are adapted to supportably contact and engage the rear surface of a panel 4, as shown in FIG. 5. To secure the connector 2 to the panel 4, each of these retaining flanges has a threaded aperture 203 for engagably receiving a respective screw 204. Securing the flanges 201, 202 against the panel stabilizes the connector 2 and prevents a loosening of the connector 2 relative to the circuit board 3.

The connector 2' illustrated in FIGS. 9–13 has one retaining flange 202' which extends downwardly from a front edge of one side of the seam 206' in the bottom wall 205' at the front of the shield 20'. Additionally, surrounding the opening, contact flanges 201' project from an opposite side of the seam 206' in the bottom wall 205', the top wall 207' and the side wall 208' of the shield 20'. The support beam 210' is disposed behind the lower contact flange 201', and the retaining flange 202', as shown in FIG. 9.

In the embodiment of FIGS. 4–8, the housing 21 has two support beams 211 which project from rear sides of the housing 21 and extend forwardly to receive side walls 208 of the shield therein. The two support beams 211, together with the insulating housing 21, clamp the two lateral side walls 208 of the metallic shield 20 and are disposed behind and abut against the back side of the retaining flange 202, when the insulating housing 21 is assembled with the metallic shield 20. The support beams 211 have flared-out front segments 213 that surround a portion of apertures 203. These support beams 211 firmly support against the retaining flanges 202, thereby preventing rearward movement of the flanges 202 and enhancing the integrity of the connector 2.

Figure 13:
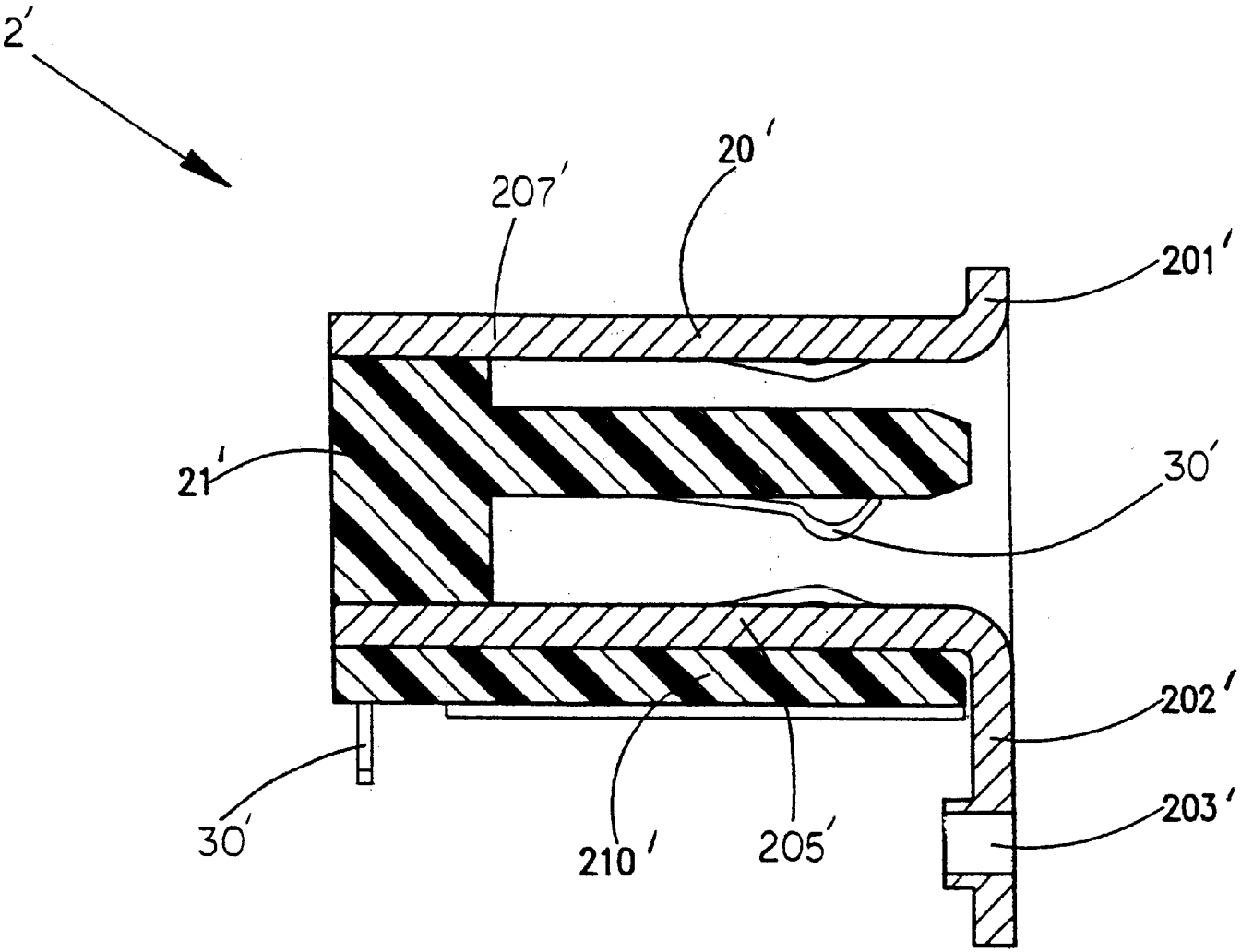
FIG. 13 is a longitudinal cross sectional view of the retaining device and connector as taken generally along line XIII—XIII of FIG. 9.

As shown in FIG. 13 and in phantom in FIG. 9, the front surface of the support beam 210' is disposed behind both the formed contact flange 201' and the retaining flange 202'. The retaining flange 202' and contact flanges 201' are adapted to supportably contact and engage the rear surface of a panel 4', as shown in FIG. 10. The retaining flange 202' has a threaded aperture 203' for engagably receiving a screw 204 to secure the connector 2' to the panel 4'. In the event that flanges 201', 202' are pushed rearwardly, the front surface support beam 210' abuts the flanges 201', 202' to prevent them from substantially deforming. The supported engagement of the flanges 201', 202' against the panel stabilizes the connector 2' during plugging and unplugging operations and prevents the connector 2' from becoming loosened relative to the circuit board 3'.

While the invention is described herein in connection with certain preferred embodiments, the invention is not limited it to those embodiments. On the contrary, it is recognized that various changes and modifications to the described embodiments will be apparent to those skilled in the art, and that such changes and modifications may be made without departing from the spirit and scope of the present invention. Accordingly, the intent is to cover all alternatives, modifications, and equivalents included within the spirit and scope of the invention as defined by the appended claims.

What is claimed is:

1. A shielded electrical connector comprising:

a housing including a terminal support and a plurality of terminal cavities in said housing;

a plurality of terminals each having a contact portion for mating with a respective terminal of a mating connector and a tail portion for engaging a respective conductor on a circuit board on which the connector is to be mounted, said terminals in respective ones of said plurality of terminal cavities;

a conductive shield around said terminal support, said shield having walls around a said terminal support, said walls including opposed side walls, a top wall and a bottom wall, at least one flange extending from one of said walls, said flange having an aperture therethrough for affixing said connector to a panel;

said housing including a support beam extending along a surface of one of said walls of said shield, said beam having a front surface disposed behind a rear surface of said flange to provide support for said flange.

2. The shielded connector of claim 1 wherein said flange extends from one of said opposed side walls.

3. The shielded connector of claim 2 wherein said support beam has a front segment which extends outwardly from said beam to provide said front surface.

4. The shielded connector of claim 3 wherein said front segment surrounds a portion of said aperture.

5. The shielded connector of claim 2 wherein an additional beam extends along an outside surface of said bottom wall.

6. The shielded connector of claim 2 wherein said tail portion is bent for surface mounting to the conductor on the circuit board.

7. The shielded connector of claim 1 wherein said flange extends from said bottom wall of said shield.

8. The shielded connector of claim 1 wherein said shield comprises a formed tube and said bottom wall of said shield is provided by two ends of the shield defining a seam therebetween.

9. The shielded connector of claim 8 wherein said flange extends from said bottom wall of said shield on one side of said seam.

10. A shielded electrical connector comprising:

a housing including a terminal support and a plurality of terminal cavities in said housing;

a plurality of terminals each having a contact portion for mating with a respective terminal of a mating connector and a tail portion for engaging a respective conductor on a circuit board on which the connector is to be mounted, said terminals in respective ones of said plurality of terminal cavities;

a conductive shield around said terminal support, said shield having walls around said terminal support, said walls including opposed side walls, a top wall and a bottom wall, a flange extending from each of said side walls, said flanges having an aperture therethrough for affixing said connector to a panel;

said housing including support beams extending along outside surfaces of respective ones of said opposed side walls of said shield, said beams each having a front surface engaging a rear surface of a respective one of said flanges.

11. A shielded electrical connector comprising:

a housing including a terminal support and a plurality of terminal cavities in said housing;

a plurality of terminals each having a contact portion for mating with a respective terminal of a mating connector and a tail portion for engaging a respective conductor on a circuit board on which the connector is to be mounted, said terminals in respective ones of said plurality of terminal cavities;

a conductive shield around said terminal support, said shield having walls around said terminal support, said walls including opposed side walls, a top wall and a bottom wall, at least one flange extending from one of said walls;

said housing including a support beam extending along a surface of one of said walls of said shield, said beam having a front surface disposed behind a rear surface of said flange to provide support for said flange.

12. The shielded connector of claim 11 wherein said flange extends from one of said opposed side walls.

13. The shielded connector of claim 12 wherein said support beam has a front segment which extends outwardly from said beam to provide said front surface.

14. The shielded connector of claim 13 wherein said front segment surrounds a portion of said aperture.

15. The shielded connector of claim 12 wherein an additional beam extends along an outside surface of said bottom wall.

16. The shielded connector of claim 11 wherein said flange extends from said bottom wall of said shield.

17. The shielded connector of claim 11 wherein said shield comprises a formed tube and said bottom wall of said shield is provided by two ends of the shield blank defining a seam therebetween.

18. The shielded connector of claim 17 wherein said flange extends from said bottom wall of said shield blank on one side of said seam.

* * * * *